US010280931B2

(12) United States Patent
Prasad DJ et al.

(10) Patent No.: US 10,280,931 B2
(45) Date of Patent: May 7, 2019

(54) SYSTEMS AND METHODS FOR SPLIT COUPLED PUMP AND JACKING GLAND

(71) Applicant: Pentair Flow Technologies, LLC, Delavan, WI (US)

(72) Inventors: Rajendra Prasad DJ, Noida (IN); Sunny Shorabh, Ghaziabad (IN)

(73) Assignee: Pentair Flow Technologies, LLC, Delavan, WI (US)

( * ) Notice: Subject to any disclaimer, the term of this patent is extended or adjusted under 35 U.S.C. 154(b) by 503 days.

(21) Appl. No.: 15/008,078

(22) Filed: Jan. 27, 2016

(65) Prior Publication Data

US 2017/0211580 A1 Jul. 27, 2017

(51) Int. Cl.

| | |
|---|---|
| ***F04D 29/10*** | (2006.01) |
| ***F04D 1/00*** | (2006.01) |
| ***F04D 17/08*** | (2006.01) |
| ***F04D 13/06*** | (2006.01) |
| ***F04D 25/06*** | (2006.01) |

(Continued)

(52) U.S. Cl.

CPC ..... *F04D 29/106* (2013.01); *F04D 1/00* (2013.01); *F04D 13/06* (2013.01); *F04D 17/08* (2013.01); *F04D 25/06* (2013.01); *F04D 29/044* (2013.01); *F04D 29/054* (2013.01); *F04D 29/102* (2013.01); *F04D 29/22* (2013.01); *F04D 29/28* (2013.01); *F04D 29/4206* (2013.01); *F04D 29/426* (2013.01)

(58) Field of Classification Search

CPC .... F04D 29/106; F04D 29/044; F04D 29/054; F04D 29/22; F04D 29/28; F04D 29/4206; F04D 29/426; F04D 29/102; F04D 25/06; F04D 1/00; F04D 13/06; F04D 17/08; F04D 29/10

See application file for complete search history.

(56) References Cited

U.S. PATENT DOCUMENTS 1,565,640 A * 12/1925 Green ..... F04B 27/0446 91/479

1,849,912 A 3/1932 Daddysman (Continued)

OTHER PUBLICATIONS

Pentair, Aurora Series 382A SC Vertical Inline Split Coupled Pumps, Installation and Handling Instructions, 12 pages, available no earlier than Jan. 28, 2015.

*Primary Examiner* — Jason D Shanske
*Assistant Examiner* — Joshua R Beebe
(74) *Attorney, Agent, or Firm* — Quarles & Brady LLP

(57) ABSTRACT

Embodiments of the invention provide a pump having a motor, a housing, a seal plate coupled to the housing and including a seal plate hub with mounting supports, an impeller arranged within the housing, a coupling assembly coupling a motor shaft and a pump shaft, and a seal and jacking assembly including a mechanical seal and a seal gland. The seal gland is removably coupled to the mounting supports and includes threaded jacking apertures extending axially through the seal gland, each configured to receive a jacking element. When the seal gland is decoupled from the mounting supports, the seal gland is moveable axially between a first position whereat the seal gland engages the mechanical seal and a second position whereat the seal gland engages a retaining ring coupled to the pump shaft in response to rotation of the jacking elements received within the pair of threaded jacking apertures.

20 Claims, 15 Drawing Sheets

(51) Int. Cl.

| | |
|---|---|
| ***F04D 29/044*** | (2006.01) |
| ***F04D 29/054*** | (2006.01) |
| ***F04D 29/22*** | (2006.01) |
| ***F04D 29/28*** | (2006.01) |
| ***F04D 29/42*** | (2006.01) |

(56) References Cited

U.S. PATENT DOCUMENTS 2,143,825 A * 1/1939 Abramson ..... F16J 15/186 277/523
2,158,327 A * 5/1939 Jaworowski ..... F16D 31/04 475/108
2,802,679 A * 8/1957 Taltavall, Jr. ..... F04D 29/126 277/348
2,834,617 A 5/1958 Creasy
3,002,776 A 10/1961 Tschappat
3,048,177 A 8/1962 Takaro
3,078,976 A * 2/1963 Whinery ..... F16D 31/04 192/61
3,233,824 A 2/1966 Johnson
3,252,192 A 5/1966 Smith
3,295,898 A * 1/1967 Finzel ..... F04D 29/126 177/59
3,711,218 A * 1/1973 Kennel ..... F04D 7/04 415/131
3,838,987 A 10/1974 Draut
3,851,983 A 12/1974 MacKenzie
4,224,363 A 9/1980 Veronesi et al.
4,240,762 A 12/1980 Lobanoff
4,256,313 A 3/1981 Arnold
4,269,417 A 5/1981 Dutton
4,289,317 A 9/1981 Kuc
4,332,391 A 6/1982 Arnold
4,421,456 A * 12/1983 Huffman ..... F04D 29/126 415/170.1
4,439,096 A * 3/1984 Rockwood ..... F04D 29/126 411/349
4,476,772 A 10/1984 Gorman et al.
4,809,992 A 3/1989 Kemp, Jr. et al.
4,858,936 A 8/1989 Adams
4,936,592 A 6/1990 Väisänen
5,045,026 A * 9/1991 Buse ..... F04D 13/024 417/360
5,090,742 A 2/1992 Cohen
5,154,652 A 10/1992 Ecklesdafer
5,208,569 A 5/1993 Michelangelo
5,336,850 A 8/1994 Mitsch
5,344,291 A * 9/1994 Antkowiak ..... F04D 13/021 415/131
5,379,519 A 1/1995 Paddock
5,490,935 A 2/1996 Guy
5,558,491 A 9/1996 Andrews
5,676,183 A 10/1997 Bravo
5,714,061 A 2/1998 Guy et al.
5,783,071 A 7/1998 Guy
5,951,860 A 9/1999 Guy
5,954,953 A 9/1999 Guy et al.
6,121,698 A 9/2000 Sexton
6,139,380 A * 10/2000 Uematsu ..... B63H 20/10 440/61 D
6,217,761 B1 4/2001 Catanzaro et al.
6,318,730 B1 11/2001 Neely
6,824,471 B2 * 11/2004 Kamenov ..... F04D 13/021 403/13
6,942,788 B1 9/2005 Cox et al.
7,005,065 B1 2/2006 Guy et al.
7,014,769 B1 3/2006 Cox et al.
7,223,343 B1 5/2007 Cox et al.
7,250,610 B1 7/2007 Cox et al.
7,341,660 B1 3/2008 Guy et al.
7,876,539 B2 1/2011 Tharp
7,980,833 B1 * 7/2011 Golden, III ..... F04B 17/03 403/16
D653,727 S 2/2012 Catanzaro et al.
8,317,201 B2 11/2012 Zebrowski
8,398,361 B2 3/2013 Sagoo et al.
2007/0261860 A1 * 11/2007 Hallonquist ..... E21B 19/02 166/381
2013/0327625 A1 12/2013 Davis et al.
2014/0263788 A1 9/2014 Vallen et al.
2014/0309796 A1 10/2014 Mueller
2015/0035232 A1 2/2015 Dewsnap
2015/0098668 A1 * 4/2015 Kattenberg ..... F16C 33/7896 384/130
2015/0226220 A1 8/2015 Bevington

* cited by examiner 161
136
168a
164a
162a
160a
161
161
164a
160a
174a
172a
170a
166a
168b
166b
124
176
158
164b
160b
160b
161
116
164b
162b
152
202
202
160b
182
198
204
200
160b
161
161
196
194
200
200
118
180
184
190
192
186
188
134
154
144
142
136
140
147
146
138
148
150
100
114
132
178

161
136
168a
164a
162a
160a
161
161
164a
160a
174a
172a
170a
166a
152
306
168b
166b
124
176
160b
158
164b
160b
161
116
324
164b
326
162b
160b
161
323
323
161
161
320
316
318
316
316
320
304
316
118
312
302
308
315
310
144
134
100
142
178
136
140
147
300
146
138
148
150
114
132

161
136
168a
164a
162a
160a
161
161
164a
160a
174a
172a
170a
166a
168b
166b
124
176
158
160b
164b
160b
161
116
417
408
417
408
418
164b
162b
160b
161
100
402
404
406
323
323
322
316
160b
161
161
420
316
318
316
420
316
403
400
118
312
308
310
315
134
134
144
142
136
140
147
300
146
138
148
150
114
132
178

SYSTEMS AND METHODS FOR SPLIT COUPLED PUMP AND JACKING GLAND

RELATED APPLICATIONS

Not Applicable.

BACKGROUND

The present invention relates generally to pumps for furnishing a fluid and, more specifically to systems and methods for a split coupled pump and jacking gland that enables the adjustment, or jacking, of an impeller assembly in, for example, a vertical in-line pump.

Typically, coupling assemblies are used to connect a drive shaft in a casing portion of a pump to a motor shaft in a motor portion of the pump in an axially aligned orientation. Coupling assemblies include a two-part sleeve (e.g., a split rigid coupling) that when assembled defines a centrally extending bore into which end portions of the motor shaft and the drive shaft are received. Screws, pins, or other fastening mechanisms may be used to physically couple each of the motor shaft and the drive shaft relative to the sleeve.

In conventional pumps, and particularly in vertical in-line pumps, the drive shaft is a pump or impeller shaft connected to an impeller. The impeller is rotatable within a pump housing, or casing, to facilitate pumping of a process fluid from an inlet of the pump housing to an outlet of the pump housing. When servicing pumps having a motor shaft and a pump shaft joined using a two-part sleeve, once the sleeve is removed the impeller is free to move. Uncontrolled movement of the impeller can cause damage to the impeller and/or the pump housing. After servicing is complete, the pump shaft and the impeller must be raised vertically, which is requires lifting of the rotating assembly, in order to re-couple the pump shaft to the motor shaft via the sleeve. This servicing process can be difficult to accomplish efficiently.

In light of the above-described deficiencies, a need exists for a system and method that enables efficient servicing of a pump (e.g., an in-line vertical pump).

SUMMARY

The aforementioned deficiencies, among others, can be overcome by providing systems and methods for a split-coupled pump and jacking gland. The split-coupled pump and jacking gland can include one or more connectors that enable efficient raising and lowering of a pump shaft and an impeller during, for instance, assembly, maintenance, and/or disassembly.

Some embodiments of the invention provide, a pump comprising a motor coupled to a motor shaft, a pump housing including an inlet and an outlet, and a seal plate coupled to the pump housing and having a seal plate hub protruding from an inner seal plate surface towards the motor. The seal plate hub defines a pump shaft aperture dimensioned to receive a pump shaft and includes a plurality of mounting supports each extending radially from a periphery of the seal plate hub. The pump further includes an impeller arranged within the pump housing and coupled to the pump shaft. The pump shaft defines a pump axis and extends from a first end arranged within the pump housing and coupled to the impeller to a second end that protrudes from the pump shaft aperture of the seal plate hub. The pump further includes a coupling assembly removably providing rotational coupling of the motor shaft and the pump shaft, and a seal and jacking assembly having a mechanical seal and a seal gland. The mechanical seal and the seal gland each include a central aperture dimensioned to receive the pump shaft. The seal gland encloses the pump shaft aperture of the seal plate hub and is removably coupled to the plurality of mounting supports of the seal plate hub. The seal gland includes a pair of threaded jacking apertures that extend axially through the seal gland each of which are configured to receive a jacking element. When the seal gland is decoupled from the plurality of mounting supports, the seal gland is moveable axially between a first position whereat the seal gland engages the mechanical seal and a second position whereat the seal gland engages a retaining ring coupled to the pump shaft in response to rotation of the jacking elements received within the pair of threaded jacking apertures.

Some embodiments of the invention provide, a pump comprising a motor coupled to a motor shaft, a pump housing including an inlet and an outlet, and a seal plate coupled to the pump housing and including a seal plate hub protruding from an inner seal plate surface towards the motor. The seal plate hub defines a pump shaft aperture dimensioned to receive a pump shaft and includes a plurality of mounting supports each extending radially from a periphery of the seal plate hub. The pump further includes an impeller arranged within the pump housing and coupled to the pump shaft. The pump shaft defines a pump axis and extends from a first end arranged within the pump housing and coupled to the impeller to a second end protruding from the pump shaft aperture of the seal plate hub. The pump further includes a coupling assembly removably providing rotational coupling of the motor shaft and the pump shaft, and a seal and jacking assembly having a mechanical seal, a seal gland, and a jacking plate. The mechanical seal and the seal gland each include a central aperture dimensioned to receive the pump shaft. The seal gland is removably coupled to the plurality of mounting supports of the seal plate hub and includes a pair of threaded jacking apertures extending axially partially through the seal gland. Each of the threaded jacking apertures are configured to receive a threaded rod. The threaded rods are each configured to receive a jacking element. The jacking plate is moveable axially between a first position whereat the jacking plate engages the mechanical seal and a second position whereat the jacking plate engages a retaining ring coupled to the pump shaft in response to rotation of the jacking elements.

Some embodiments of the invention provide, a pump including a motor coupled to a motor shaft, a pump housing having an inlet and an outlet, and a seal plate coupled to the pump housing and having a seal plate hub protruding from an inner seal plate surface towards the motor. The seal plate hub defines a pump shaft aperture dimensioned to receive a pump shaft and includes a plurality of mounting supports each extending radially from a periphery of the seal plate hub. The pump further includes an impeller arranged within the pump housing and coupled to the pump shaft. The pump shaft defines a pump axis and extends from a first end arranged within the pump housing and coupled to the impeller to a second end protruding from the pump shaft aperture of the seal plate hub. The pump further includes a coupling assembly removably providing rotational coupling of the motor shaft and the pump shaft, and a seal and jacking assembly having a mechanical seal, a seal gland, and a jacking plate. The mechanical seal and the seal gland each include a central aperture dimensioned to receive the pump shaft. The seal gland removably coupled to the plurality of mounting supports of the seal plate hub and includes a pair of clearance apertures extending axially partially through the seal gland. Each of the pair clearance apertures are configured to receive and support a jacking element. The jacking plate is moveable axially between a first position whereat the jacking plate engages the mechanical seal and a second position whereat the jacking plate engages a retaining ring coupled to the pump shaft in response to rotation of the jacking elements.

DETAILED DESCRIPTION

Figure 1:
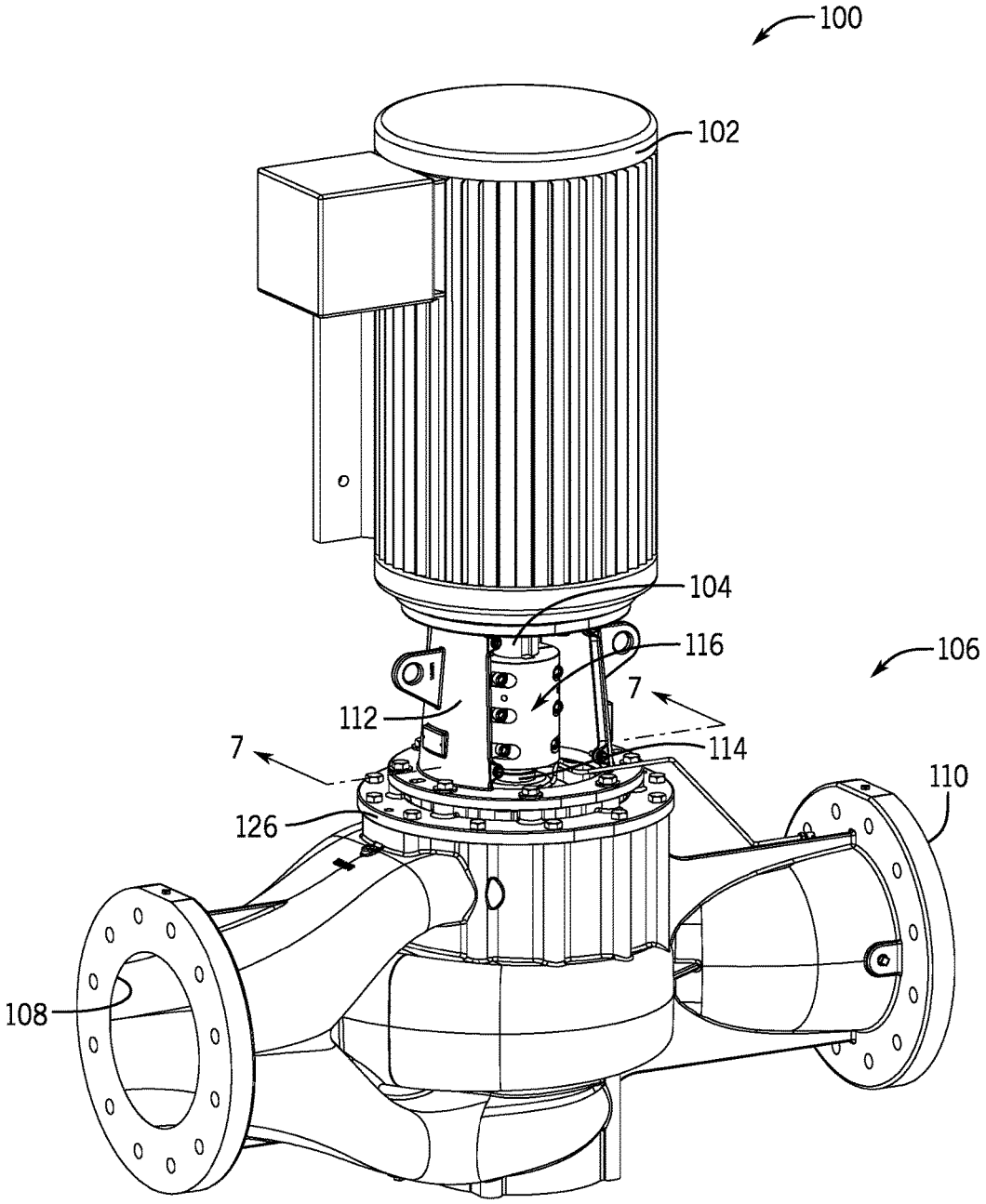
FIG. 1 is a perspective view of a pump having a seal and jacking assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

In general, two types of arrangements are described herein for jacking (i.e., raising and/or lowering of a pump shaft and impeller assembly) depending on the type of mechanical seal used on a pump. In one embodiment, a pump offered with an inside mechanical seal (e.g., John Crane Type 1/Type 21) uses threaded fasteners to directly jack the seal gland (i.e., the seal gland acts as jacking gland). In another embodiment, a pump offered with an outside mechanical seal (e.g., John Crane Type 8B2) may either use, for example, wing nuts and a jacking plate connected to threaded connector rods fastened to the gland plate for raising and lowering the shaft and impeller assembly, or use threaded fasteners inserted into a jacking plate.

FIG. 1 shows a vertical in-line pump 100 constructed with an internal mechanical seal (e.g., John Crane Type 1/Type 21) according to one embodiment of the invention. The pump 100 includes a motor 102 having a rotatable motor shaft 104, and a pump housing 106. The illustrated motor 102 is an electric motor. In other embodiments, the motor 102 may be an internal combustion engine or a hydraulic motor. The pump housing 106 includes an inlet 108 and an outlet 110, and is coupled to the motor 102 via a bracket 112. The bracket 112 is dimensioned to ensure that, when the pump 100 is assembled, the motor shaft 104 is aligned with a pump shaft 114. The motor shaft 104 is coupled to the pump shaft 114 by a coupling assembly 116. The coupling assembly 116, when assembled, couples the pump shaft 114 to the motor shaft 104 such that the pump shaft 114 generally rotates in unison with the motor shaft 104.

Figure 2:
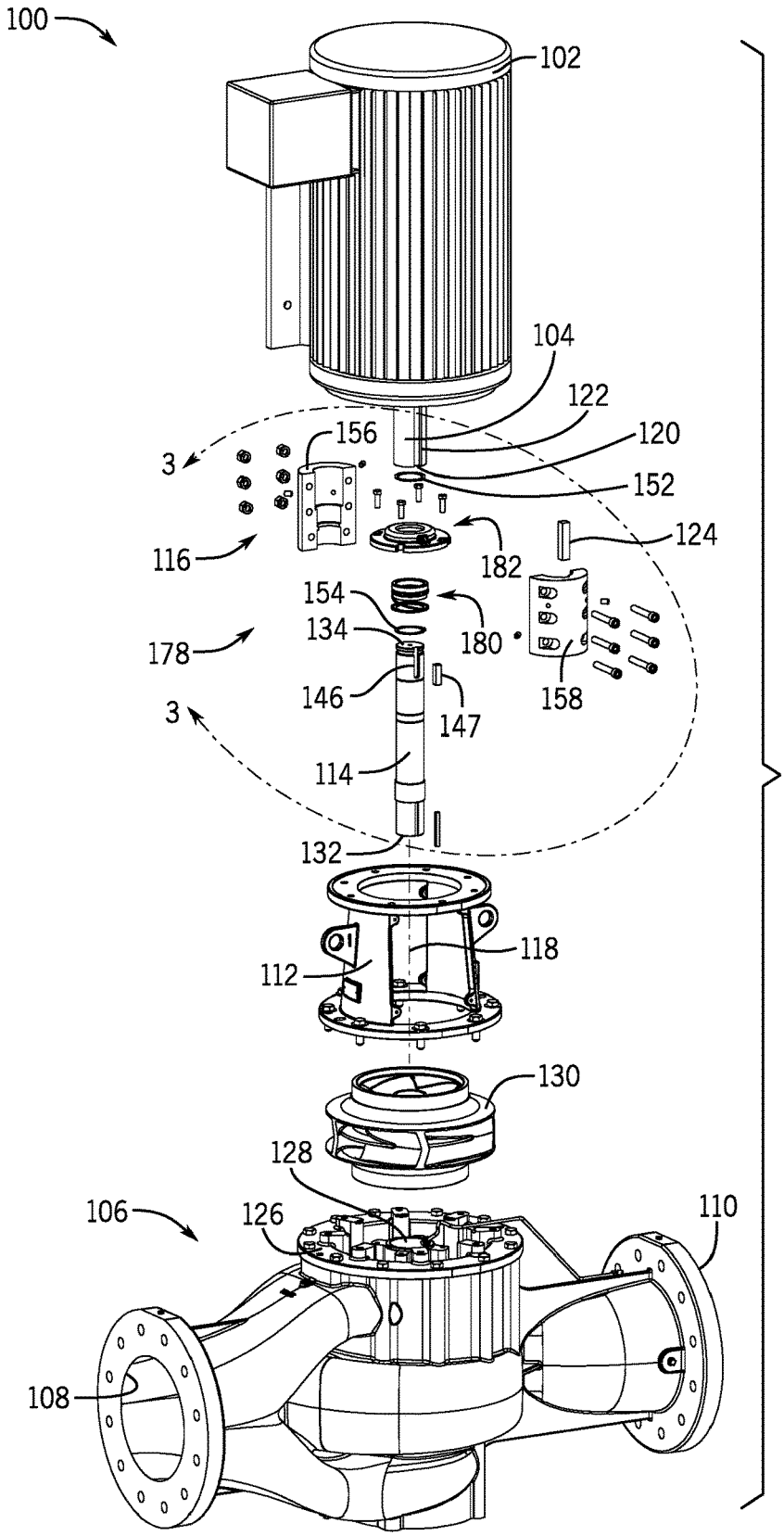
FIG. 2 is an exploded view of the pump of FIG. 1.

As shown in FIG. 2, the motor shaft 104 defines a generally cylindrical shape and is rotatable about a pump axis 118. The motor shaft 104 includes a distal end 120 that is configured to be received within the coupling assembly 116. The motor shaft 104 includes a motor shaft keyway 122 that defines a recess that extends axially along a radial edge of the motor shaft 104 and terminates at the distal end 120 of the motor shaft 104. The motor shaft keyway 122 is dimensioned to receive a corresponding motor shaft key 124. The motor shaft key 124 enables the motor shaft 104 to be rotationally secured within the coupling assembly 116.

The pump housing 106 includes a seal plate 126 secured to the pump housing 106 between the inlet 108 and the outlet 110. The seal plate 126 is configured to be coupled to the bracket 112 by an array of fasteners, and defines an upper portion of a pump shaft aperture 128 of the pump housing 106 dimensioned to receive the pump shaft 114. The pump shaft 114 is configured to be coupled to an impeller 130 at a first end 132 of the pump shaft 114 so the impeller 130 rotates with the pump shaft 114. The impeller 130 can be coupled to the first end 132 of the pump shaft 114 using, for example, a bolt, a screw, a rivet, or a weld. In some embodiments, the impeller 130 can be removably coupled to the first end 132 of the pump shaft 114 using a bolt or a screw. The rotational coupling of the pump shaft 114, the impeller 130, and the motor shaft 104 enable the motor 102 to drive the rotation of the impeller 130 during operation of the pump 100. As is known in the art, this enables the pump 100 to draw in a process fluid at the inlet 108 of the pump housing 106 and furnish the process fluid under increased pressure at the outlet 110 of the pump housing 106.

Figure 3:
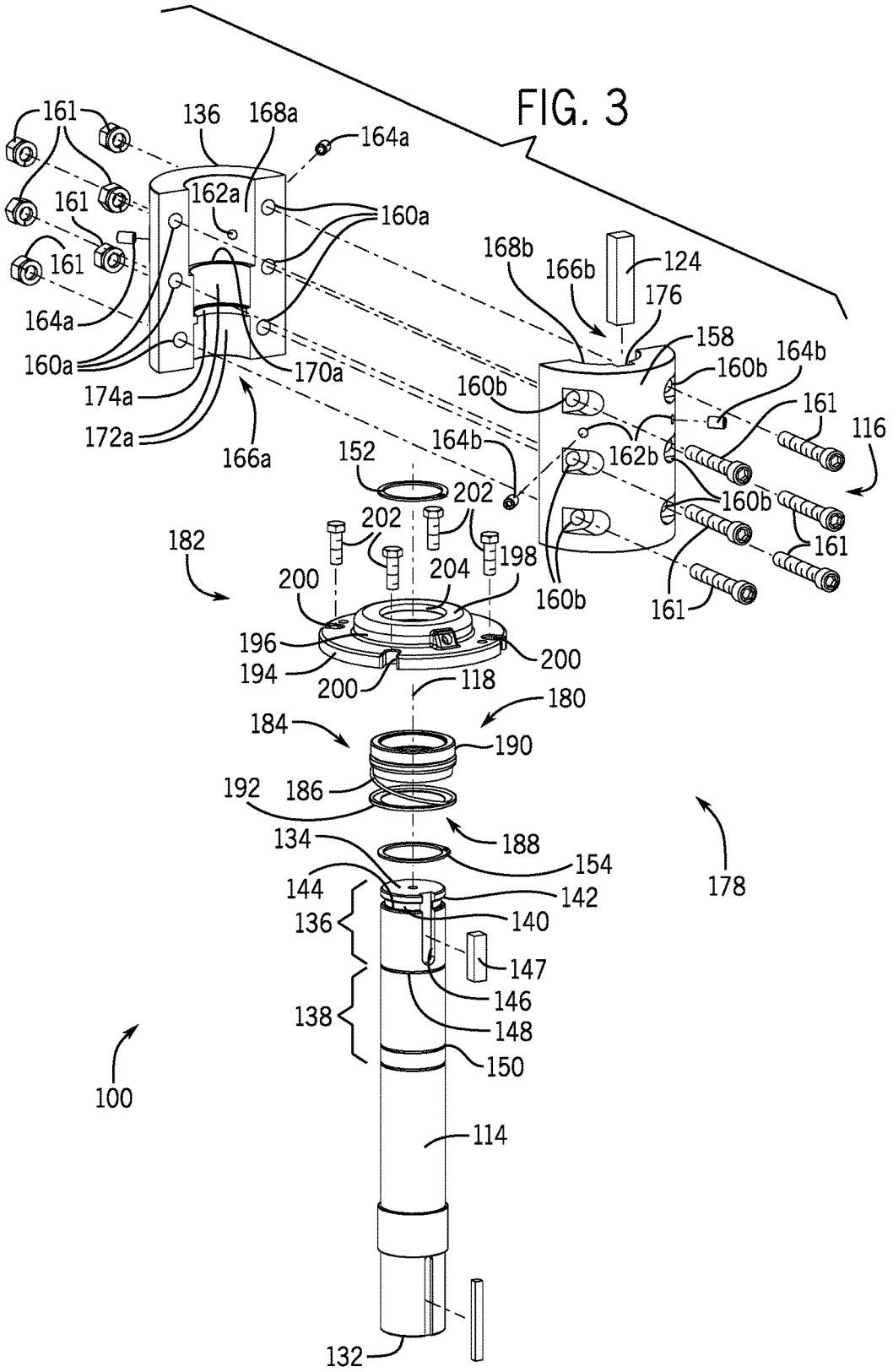
FIG. 3 is a magnified view of the seal and jacking assembly of the pump of FIG. 2 circumscribed by arc 3-3.

As shown in FIG. 3, the pump shaft 114 defines a generally cylindrical shape and is configured to be received within and extend from the pump shaft aperture 128 (shown in FIG. 4) in the pump housing 106. When assembled, the pump shaft aperture 128 is dimensioned to axially align the pump shaft 114 along the pump axis 118 with the motor shaft 104 for rotation about the pump axis 118. The pump shaft 114 extends from the first end 132 to a second end 134, and includes a first upper portion 136 and a second upper portion 138. The first upper portion 136 includes an annular groove 140 arranged adjacent to the second end 134 of the pump shaft 114. The annular groove 140 defines an opposing pair of radially extending shoulders 142 and 144. Similar to the motor shaft 104, the first upper portion 136 of the pump shaft 114 includes a pump shaft keyway 146. The pump shaft keyway 146 defines a recess that extends axially along a radial edge of the first upper portion 136 of the pump shaft 114 and terminates at the second end 134 of the pump shaft 114. The pump shaft keyway 146 is dimensioned to received a corresponding pump shaft key 147.

The second upper portion 138 of the pump shaft 114 includes a second annular groove 148 and a third annular groove 150. The second annular groove 148 is configured to receive a retaining ring 152, and the third annular groove 150 is configured to receive a snap ring 154.

When assembled, the coupling assembly 116 is configured to receive and couple the distal end 120 of the motor shaft 104 and the second end 134 of the pump shaft 114 to enable the motor shaft 104 to rotatably drive the pump shaft 114. The coupling assembly 116 includes a first sleeve half 156 and a second sleeve half 158, which each define a generally semi-cylindrical shape. The first sleeve half 156 is similar to the second sleeve half 158 with like components denoted using an "a" for the first sleeve half 156 and a "b" for the second sleeve half 158. The following description of the first sleeve half 156 also applies to the second sleeve half 158. The first sleeve half 156 includes a plurality of fastening apertures 160*a* that extend through the first sleeve half 156 and are arranged at longitudinally spaced locations on the first sleeve half 156. When the coupling assembly 116 is assembled, each of the plurality of fastening apertures 160*a* on the first sleeve half 156 are arranged to align with a corresponding one of the plurality of fastening apertures 160*b* on the second sleeve half 158, and are each configured to receive a fastening element 161 to fasten the first sleeve half 156 and the second sleeve half 158 (i.e., the illustrated coupling assembly 116 is a split-coupled assembly). In some embodiments, the fastening elements 161 can be a screw, a pin, a bolt and a nut, or any other fastening mechanism. The illustrated fastening elements 161 are in the form of a threaded bolt and a nut. It should be known that, in other embodiments, the size and number of the plurality of fastening apertures 160*a*/160*b* and corresponding fastening elements 161 may vary depending on the overall mass and applied forces of the impeller 130, or other application-specific requirements.

The first sleeve half 156 includes a plurality of threaded apertures 162*a* each configured to receive a threaded fastener 164*a*, and an internal section 166*a*. The threaded fasteners 164*a* are configured to be radially inserted into a corresponding one of the plurality of threaded apertures 162*a* to tighten the grip of the coupling assembly 116 on the motor shaft 104 and inhibit movement of the coupling assembly 116 along the pump axis 118. It should be known that, in other embodiments, the size and number of the plurality of threaded apertures 162*a* and corresponding size and number of the threaded fasteners 164*a* in the coupling assembly 116 may vary depending on application specifics, such as the overall mass and applied forces of the impeller 130.

The internal section 166*a* includes a motor shaft surface 168*a*, a step 170*a*, a pump shaft surface 172*a*, and a pump shaft collar 174*a*. The motor shaft surface 168*a* combines, when assembled, with the motor shaft surface 168*b* to define a motor shaft bore in the coupling assembly 116 that is dimensioned to receive the motor shaft 104. The step 170*a* extends towards the pump axis 118 and thus reduces a radius defined by the internal section 166*a* of the first sleeve half 156. The step 170*a* provides a stop for the distal end 120 of the motor shaft 104 to engage during assembly of the coupling assembly 116. The pump shaft surface 172*a* combines, when assembled, with the pump shaft surface 172*b* to define a pump shaft bore in the coupling assembly 116 that is dimensioned to receive the pump shaft 114. The annular groove 140 of the pump shaft 114 is configured to receive the pump shaft collars 174*a* and 174*b* to axially secure the first upper portion 136 of the pump shaft 114 within the coupling assembly 116.

The second sleeve half 158 includes a motor key recess 176 in the motor shaft surface 168*b*, and a pump key recess (not shown) in the pump shaft surface 172*b*. The motor key recess 176 and the motor shaft keyway 122 are configured to receive the motor shaft key 124 to rotationally secure the motor shaft 104 within the coupling assembly 116. Similarly, the pump key recess and the pump shaft keyway 146 are configured to receive the pump shaft key 147 to rotationally secure the pump shaft 114 within the coupling assembly 116. In this way, the motor shaft 104 and the pump shaft 114 are prevented from rotationally slipping with respect to one another during operation of the pump 100.

With continued reference to FIG. 3, the pump 100 includes a seal and jacking assembly 178. The seal and jacking assembly 178 includes a mechanical seal 180 and a seal gland 182, both configured to receive the pump shaft 114 and that cooperate to provide a seal between the pump housing 106 and the pump shaft 114. The illustrated mechanical seal 180 is an internal mechanical seal (e.g., John Crane Type 1/Type 21), which includes a mechanical seal assembly 184 that is biased towards the seal gland 182 by a seal spring 186. The mechanical seal assembly 184 defines a central seal aperture 188 dimensioned to receive the first upper portion 136 of the pump shaft 114. As is known in the art, the mechanical seal assembly 184 can include one or more of a stationary seat, flexible elbows, a retainer, and a drive ring, among other things. The mechanical seal assembly 184 includes an upper collar 190 dimensioned to be received by the seal gland 182, as will be described below. When assembled, a washer 192 engages the snap ring 154 and the seal spring 186. In this way, the snap ring 154 acts as a lower stop, or rest, for the mechanical seal 180, and provides a solid, stationary, surface for the seal spring 186 to press against and force the mechanical seal assembly 184 towards the seal gland 182.

The seal gland 182 defines a generally annular shape and includes an annular disk 194 extending away from the pump axis 118, a central hub 196 extending substantially perpendicularly from the interior of the annular disk 194, and a seal lip 198 extending radially inward. The annular disk 194 is configured to engage the seal plate 126 and includes a plurality of fastening recesses 200. The plurality of fastening recesses 200 are formed on a periphery of the annular disk 194 and are spaced circumferentially around the periphery of the annular disk 194. Each of the plurality of fastening recesses 200 are configured to receive a fastening element 202 to fasten the seal gland 182 to the seal plate 126, as will be described below. The illustrated fastening elements 202 are in the form of a threaded bolt. The seal lip 198 extends towards the pump axis 118 from a distal end of the central hub 196 and defines a seal pump aperture 204 dimensioned to receive the pump shaft 114.

Figure 4:
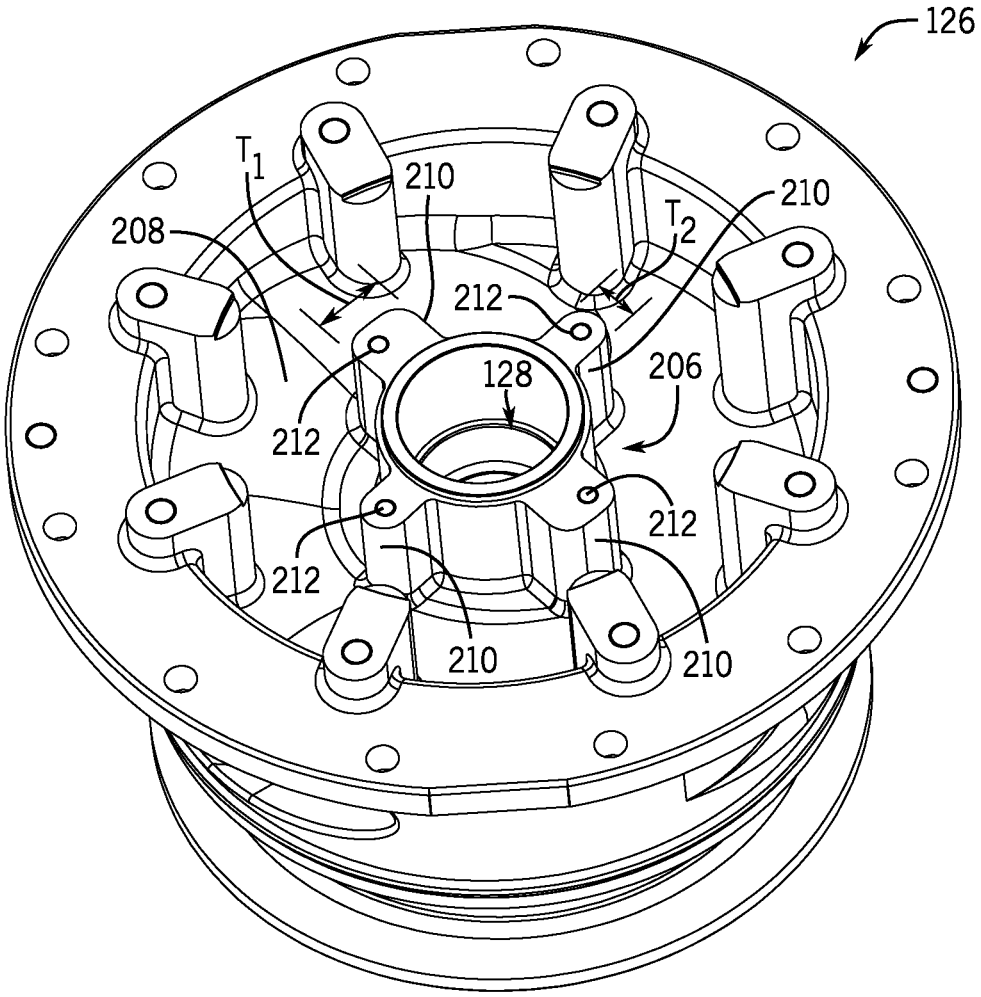
FIG. 4 is an isometric view of a seal plate of the pump of FIG. 1.

As shown in FIG. 4, the seal plate 126 includes a seal plate hub 206 protruding from an inner seal plate surface 208 towards the motor 102. The seal plate hub 206 defines an upper portion of the pump shaft aperture 128, and includes a plurality of mounting supports 210 each extending radially from a periphery of the seal plate hub 206. The illustrated seal plate hub 206 includes four mounting supports 210 (i.e., a corresponding mounting support 210 for each fastening recess 200 in the seal gland 182). In other embodiments, the seal plate hub 206 may have more or less than four mounting supports 210 depending on the number of fastening recesses 200 and fastening elements 202 in the seal gland 182. Each of the plurality of mounting supports 210 includes a threaded seal mounting aperture 212 configured to receive one of the plurality of fastening elements 202. In assembly, the seal gland 182 is placed on the seal plate hub 206 such that each of the plurality of fastening recesses 200 align with the plurality of threaded seal mounting apertures 212. Then the plurality of fastening elements 202 can be threaded into the threaded seal mounting apertures 212 to fasten the seal gland 182 to the seal plate hub 206.

An opposing pair of the plurality of mounting supports 210 define a thickness $T_1$ that is greater than a thickness $T_2$ defined by the other opposing pair of the plurality of mounting supports 210. The greater thickness $T_1$ of the opposing pair of the plurality of mounting supports 210 provides support for jacking of the seal gland 182, as will be described below.

Figure 5:
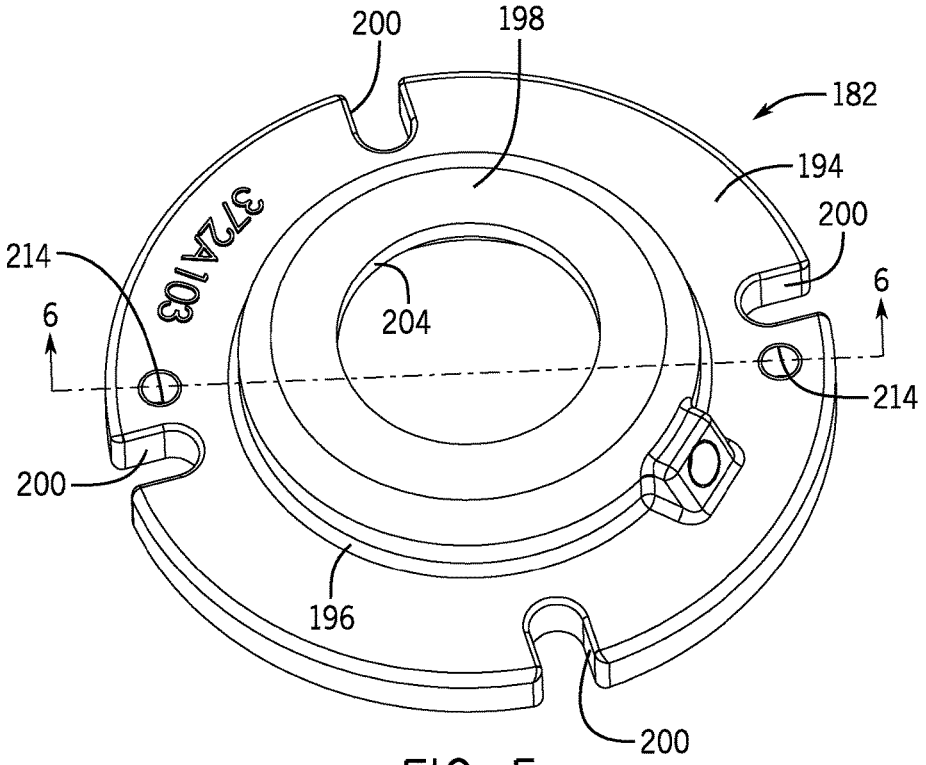
FIG. 5 is an isometric view of a seal gland of FIG. 3.
Figure 6:
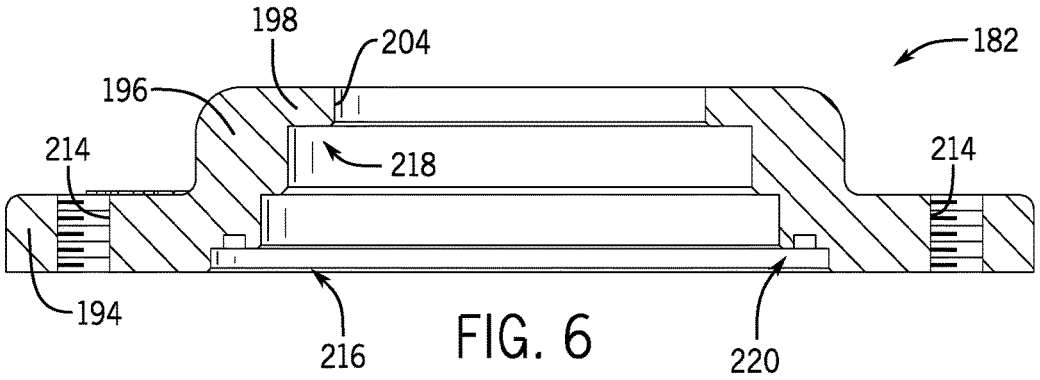
FIG. 6 is a cross-sectional view of the seal gland of FIG. 5 taken along line 6-6.

As shown in FIGS. 5 and 6, the seal gland 182 includes an opposing pair of threaded jacking apertures 214. The pair of threaded jacking apertures 214 extend through the annular disk 194 of the seal gland 182. This enables a pair of the plurality of fastening elements 202 to be threaded through the pair of threaded jacking apertures 214 to engage the thicker pair of the plurality of mounting supports 210 and then jack, or displace, the seal gland 182 relative to the seal plate 126.

An internal section 216 of the seal gland 182 defines a mechanical seal notch 218 and a central hub notch 220. The mechanical seal notch 218 is dimensioned to sealingly receive the upper collar 190 of the mechanical seal assembly 184. When assembled, the upper collar 190 is forced into the mechanical seal notch 218 by the seal spring 186 to form a seal between the seal gland 182 and the mechanical seal 180. The seal between the seal gland 182 and the mechanical seal 180 prevents process fluid from leaking out of the pump housing 106 during operation of the pump 100. The central hub notch 220 is dimensioned to receive an upper portion of the seal plate hub 206, and may support a sealing member (e.g., an o-ring) in a recess within the central hub notch 220.

At certain intervals during operation of the pump 100, the mechanical seal 180 must be replaced or serviced. The seal and jacking assembly 178 is constructed to enable efficient removal, service, and/or replacement the mechanical seal 180. One non-limiting example of the steps to remove, service, and/or replace the mechanical seal 180 will be described below with reference to FIGS. 7-9.

Figure 7:
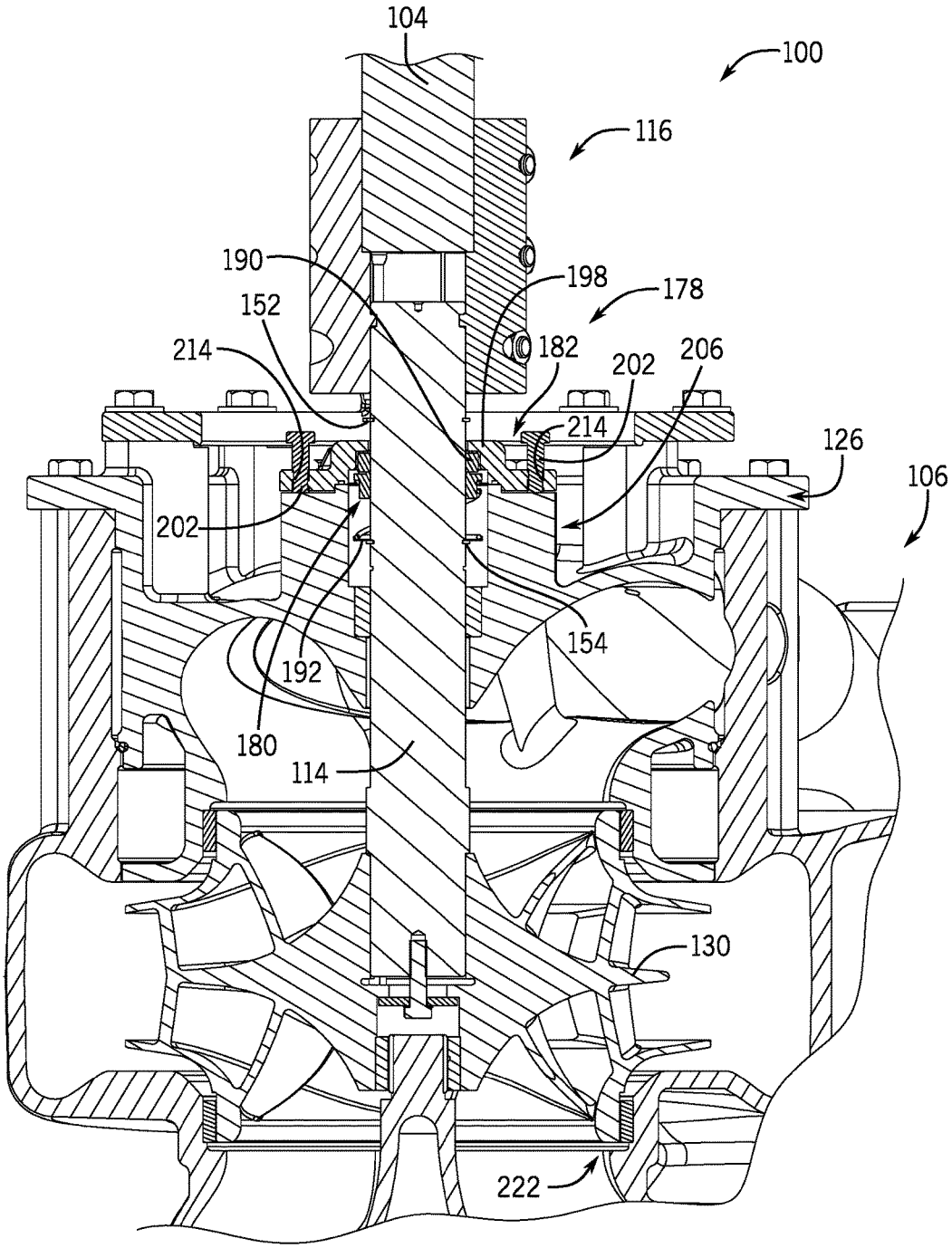
FIG. 7 is a partial cross-sectional view of the pump of FIG. 1 taken along line 7-7 with the seal gland of FIG. 3 in a first position according to one embodiment of the invention.

FIG. 7 shows one arrangement of the seal and jacking assembly 178 that can be used during operation of the pump 100. As shown in FIG. 7, the seal gland 182 is in a first position where the seal lip 198 engages the mechanical seal 180 (i.e., the upper collar 190 of the mechanical seal 180 is sealingly received within the mechanical seal notch 218 of the seal gland 182). The sealing engagement between the mechanical seal 180 and the seal gland 182 is maintained, during operation, by the seal spring 186 using the snap ring 154 as a support to force the mechanical seal 180 into the seal gland 182. In this arrangement, the plurality of fastening elements 202 are threaded into a corresponding one of the plurality of seal mounting apertures 212 to fasten the seal gland 182 to the seal plate hub 206.

Figure 8:
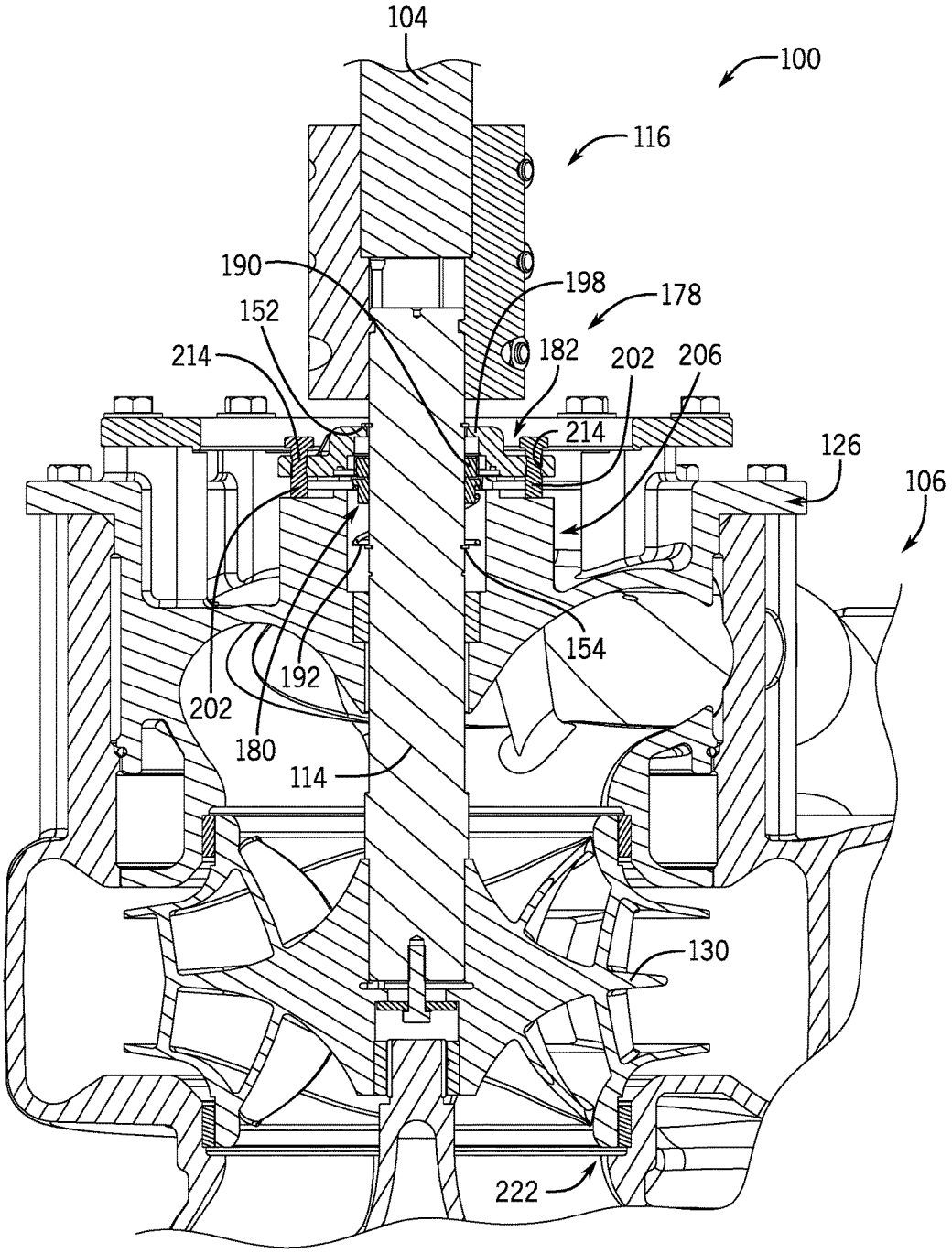
FIG. 8 is a partial cross-sectional view similar to FIG. 7 with the seal gland of FIG. 3 in a second position according to one embodiment of the invention.

From the arrangement shown in FIG. 7, once the pump 100 is no longer in operation, the plurality of fastening elements 202 are removed from the plurality of seal mounting apertures 212 to release the seal gland 182 from the seal plate hub 206. Then two of the plurality of fastening elements 202 (or other appropriate threaded elements) are threaded into the pair of threaded jacking apertures 214 in the seal gland 182. Once the two fastening elements 202 are threaded through the pair of threaded jacking apertures 214 (i.e., through the annular disk 194), the two fastening elements 202 engage the thicker pair of the plurality of mounting supports 210. Continued threading of the two fastening elements 202, once they have engaged the thicker pair of the plurality of mounting supports 210, will result in the seal gland 182 displacing axially upwards, or jacking, towards the motor shaft 104. The seal gland 182 will continue to displace axially towards the motor 102 until the seal gland 182 reaches the second position whereat the seal lip 198 engages the retaining ring 152, as shown in FIG. 8. With the seal gland 182 in the second position, the seal gland 182 supports the weight of the pump shaft 114 and the impeller 130. This enables the pump shaft 114 and the motor shaft 104 to be decoupled by removing the fastening elements 161 from the coupling assembly 116 and then removing the coupling assembly 116.

Figure 9:
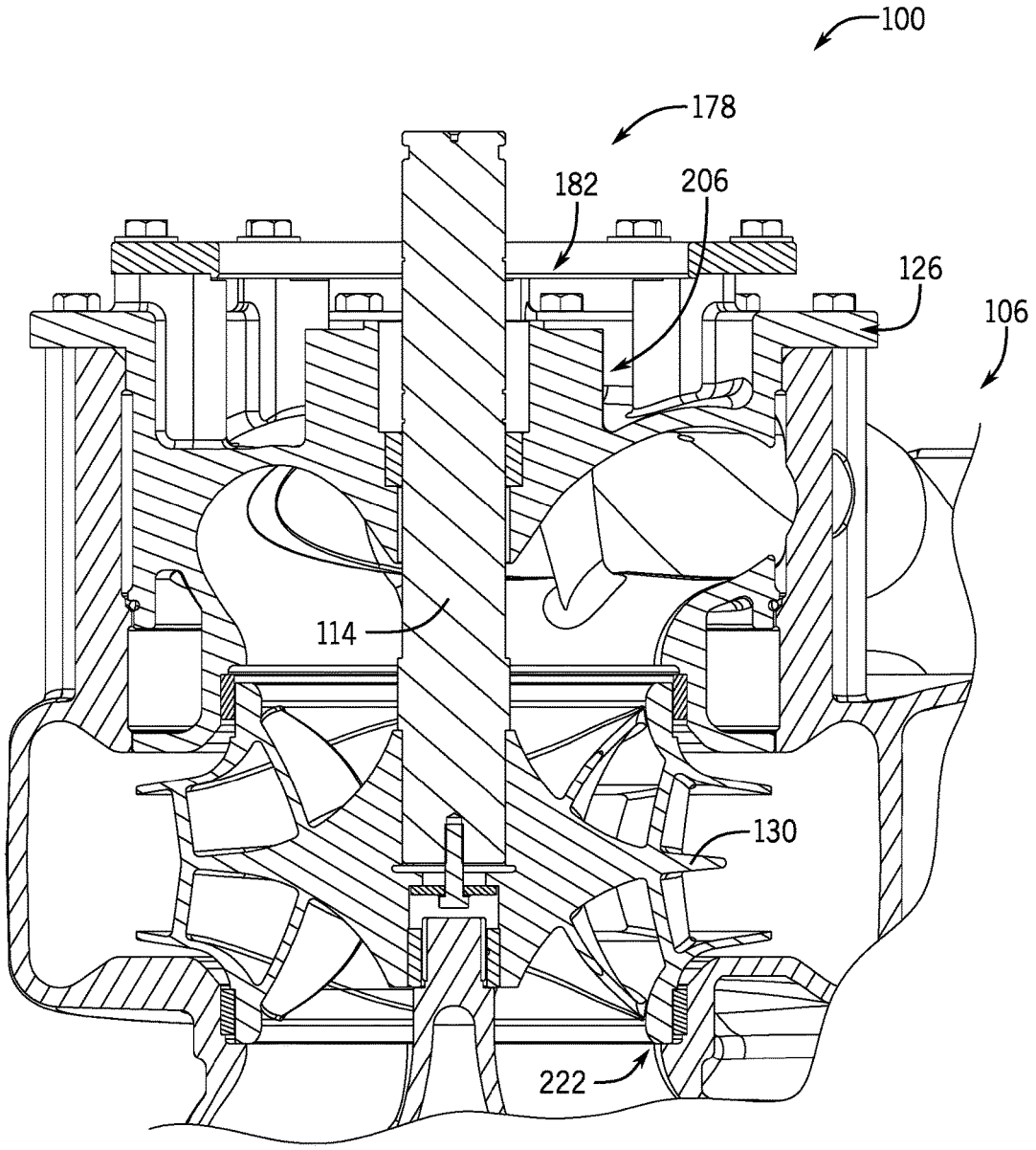
FIG. 9 is a partial cross-sectional view similar to FIG. 7 with the coupling assembly, the seal gland, and the mechanical seal of FIG. 3 removed.

Once the coupling assembly 116 is removed and the pump shaft 114 and the motor shaft 104 are decoupled, the pair of fastening elements 202 can be rotated within the pair of threaded jacking apertures 214 to move the seal gland 182 back towards the first position (i.e., towards the mechanical seal 180). Since the pump shaft 114 and the motor shaft 104 are now decoupled, the lowering (i.e., moving from the second position towards the first position) of the seal gland 182 simultaneously lowers the pump shaft 114 and the impeller 130. The pump shaft 114 and the impeller 130 continue to lower via the jacking of the seal gland 182 until the impeller 130 contacts a shoulder 222 within the pump housing 106, as shown in FIG. 9. With the weight of the impeller 130 supported by the shoulder 222 of the pump housing 106, the retaining ring 152 is removed from the pump shaft 114, which permits the seal gland 182 to be removed. Removing the seal gland 182 provides access to the mechanical seal 180. At this point, the mechanical seal 180 can be removed, service, inspected, and/or replaced. The pump 100 is then reassembled, with a new/serviced mechanical seal 180, by repeating the above-described steps in reverse order. As described above, in this embodiment of the seal and jacking assembly 178, the seal gland 182 acts to both provide a seal with the mechanical seal 180, and to jack the pump shaft 114 and the impeller 130 during maintenance. That is, the seal gland 182 functions as both as a seal gland and a jacking gland.

Figure 10:
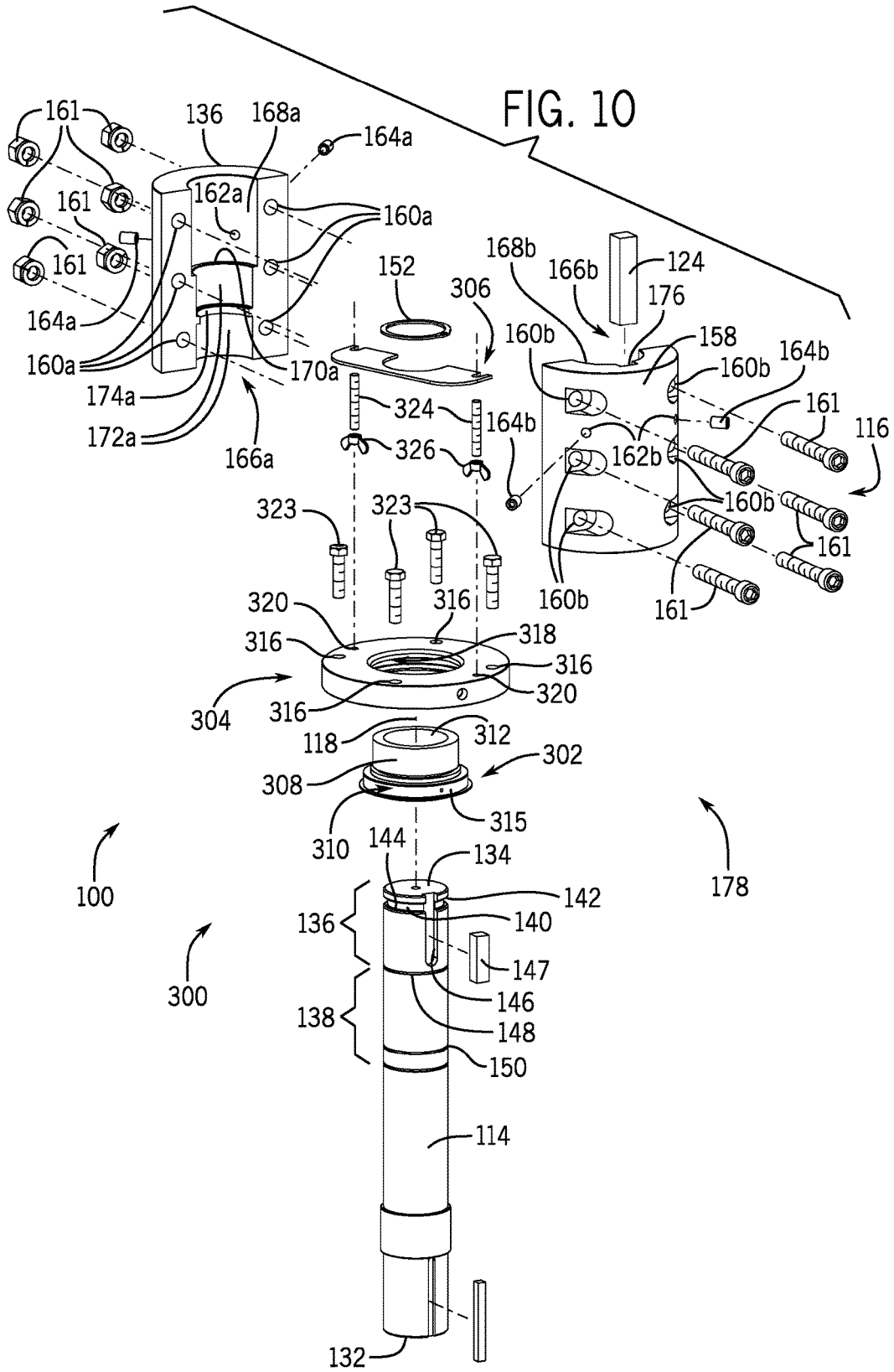
FIG. 10 is an exploded view of a seal and jacking assembly of the pump of FIG. 1 according to another embodiment of the invention.

FIG. 10 shows a seal and jacking assembly 300 according to another embodiment of the present invention. The seal and jacking assembly 300 can be utilized when the pump 100 is constructed with an external mechanical seal (e.g., John Crane Type 8B2). As shown in FIG. 10, the seal and jacking assembly 300 includes a mechanical seal 302, a seal gland 304, and a jacking plate 306. The mechanical seal 302 and the seal gland 304 are both configured to receive the pump shaft 114 and cooperate to provide a seal between the pump housing 106 and the pump shaft 114. The illustrated mechanical seal 302 is an external mechanical seal (e.g., John Crane Type 8B2) that includes a rotating sleeve 308 and a stationary sleeve 310. The rotating sleeve 308 defines a central aperture 312 dimensioned to receive and engage the pump shaft 114. That is, when assembled, the central aperture 312 of the rotating sleeve 308 engages the pump shaft 114 so the rotating sleeve 308 rotates with the pump shaft 114. The stationary sleeve 310 defines a central aperture (not shown) dimensioned to receive the pump shaft 114, and includes an outer collar 315 dimensioned to be received by the seal gland 304, as will be described below.

The seal gland 304 defines a generally annular disk shape and is configured to engage the seal plate hub 206. The seal gland 304 includes a plurality of fastening apertures 316, a central aperture 318, and an opposing pair of jacking apertures 320. The plurality of fastening apertures 316 extend through the seal gland 304 and are spaced circumferentially around the seal gland 316. Each of the plurality of fastening apertures 316 is configured to receive a fastening element 322 to fasten the seal gland 304 to seal plate hub 206, as will be described below. The illustrated fastening elements 322 are in the form of a threaded bolt. The central aperture 318 is dimensioned to receive the pump shaft 114 and the rotating sleeve 308 of the mechanical seal 302. The pair of jacking apertures 320 are threaded and are each configured to receive a threaded rod 324. When assembled, a jacking element 326 is threaded onto each of the threaded rods 324 to set a height for the jacking plate 306 relative to the seal gland 304, and to enable axial displacement of the jacking plate 306 along the pump axis 118. The illustrated jacking elements 326 are in the form of a wing nut. In other embodiments, the jacking elements 326 may be in the form of a hexagonal nut or any other form of threaded member having an engagement surface for abutting the jacking plate 306.

Figure 11:
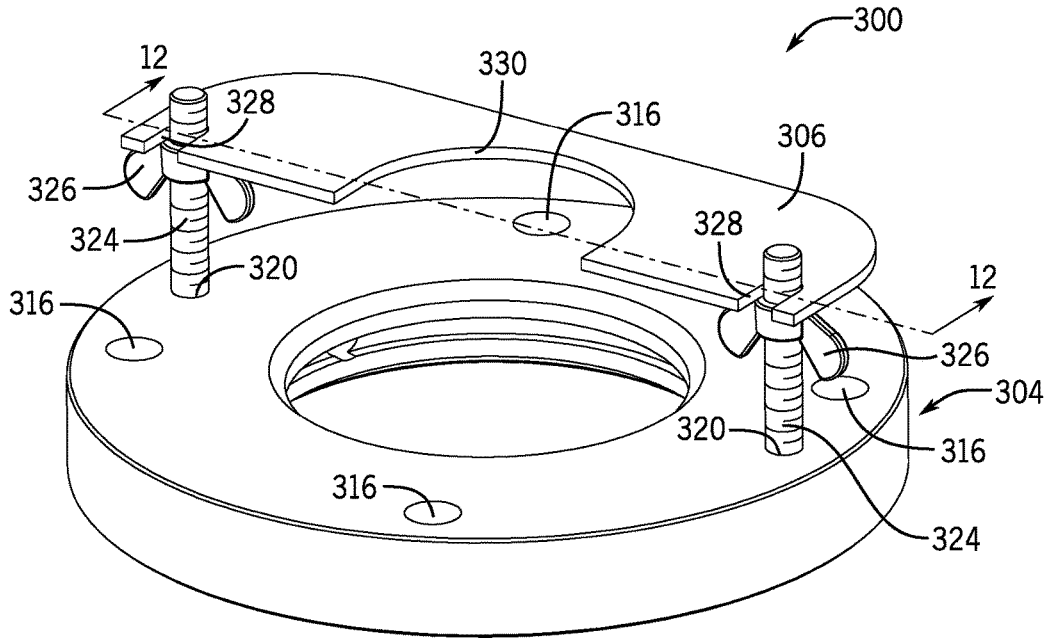
FIG. 11 is an isometric view of a seal gland and a jacking plate of FIG. 10.
Figure 12:
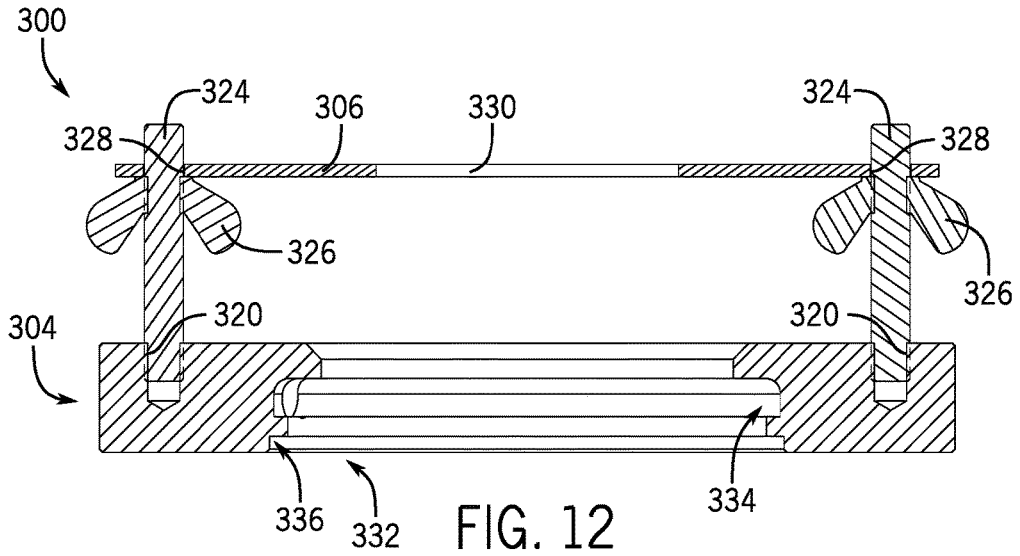
FIG. 12 is a cross-sectional view of the seal gland and the jacking plate of FIG. 11 taken along line 12-12.

As shown in FIGS. 11 and 12, the jacking plate 306 defines a generally flat shape (i.e., when assembled, the entire jacking plate 306 is arranged substantially perpendicular to the pump axis 118). The jacking plate 306 includes a pair of jacking recesses 328 arranged at opposing ends of the jacking plate 306, and a pump shaft recess 330 arranged in-between the pair of jacking recesses 328. The pair of jacking recesses 328 are each configured to receive one of the threaded rods 324. The pump shaft recess 330 defines a generally semi-circular shape that includes a radius that is greater than a radius defined by the pump shaft 114, but less than the radius defined by the retaining ring 152. In this way, the jacking plate 306 is configured to slidably displace along the pump shaft 114 until the jacking plate 306 is stopped by engagement with the retaining ring 152. As shown in FIG. 12, the pair of jacking apertures 320 extend partially through the seal gland 304. That is, the pair of jacking apertures 320 do not extend completely through the seal gland 304 to enable the threaded rods 324 to be tightened within the pair of jacking apertures 320 and prevent rotation of the threaded rods 324 in response to rotation of the jacking elements 326. In other forms, the threaded rods 324 may be partially threaded to define a non-threaded central portion, which functions to define the amount of engagement between the threaded rod 324 and the jacking aperture 320.

An internal section 332 of the seal gland 304 defines a mechanical seal recess 334 and a central hub notch 336. The mechanical seal recess 334 is dimensioned to sealingly receive the outer collar 315 of stationary sleeve 310. When assembled, the outer collar 315 is compressed between the mechanical seal recess 334 and the seal plate hub 206 to secure the stationary sleeve 310 and prevent rotation of the stationary sleeve 310 with the rotating sleeve 308. Also, the mechanical seal recess 334 is dimensioned slightly larger than the outer collar 315 to define a lubrication flow path around the periphery of the stationary sleeve 310. The central hub notch 336 is dimensioned to receive an upper portion of the seal plate hub 206.

Similar to the seal and jacking assembly 178, described above, the seal and jacking assembly 300 is constructed to enable efficient removal, service, and/or replacement of the mechanical seal 302 during maintenance of the pump 100. One non-limiting example of the steps to remove and replace the mechanical seal 302 will be described with reference to FIGS. 13-15.

Figure 13:
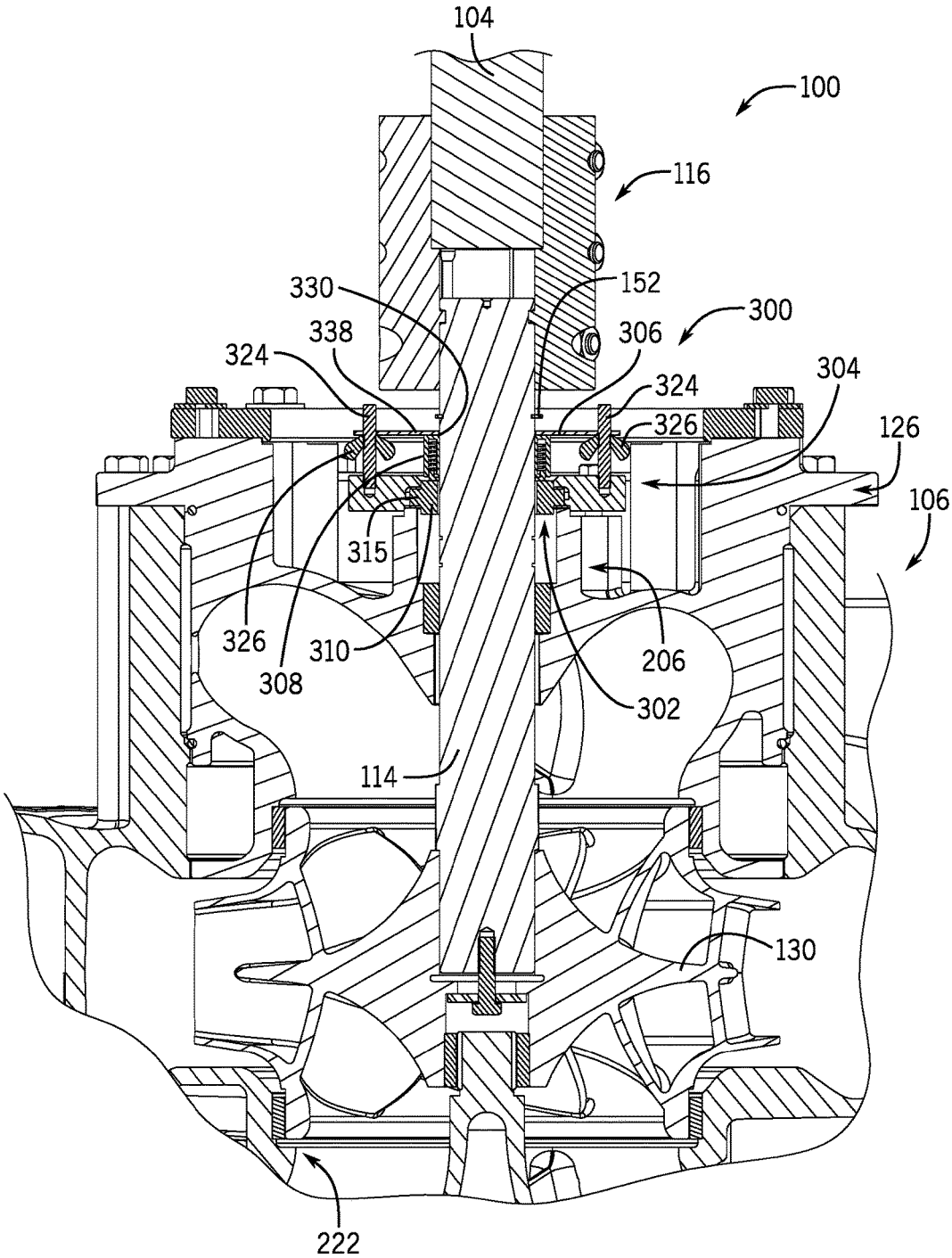
FIG. 13 is a partial cross-sectional view of the pump of FIG. 1 with the seal and jacking assembly of FIG. 10 in a first position according to another embodiment of the invention.

FIG. 13 shows one arrangement of the seal and jacking assembly 300 that can be used during operation of the pump 100. As shown in FIG. 13, the jacking plate 306 is in a first position whereat the jacking plate 306 engages the mechanical seal 302 (i.e., the pump shaft recess 330 engages an upper surface 338 of the rotating sleeve 308). To position the jacking plate 306 in the first position, the jacking elements 326 can be threaded (i.e., rotated) to displace the jacking plate 306 down axially along the pump axis 118 until the pump shaft recess 330 engages the upper surface 338 of the rotating sleeve 308. In this arrangement, the plurality of fastening elements 322 are placed through a corresponding one of the plurality of fastening apertures 316 in the seal gland 304 and threaded into a corresponding one of the plurality of seal mounting apertures 212 to fasten the seal gland 304 to the seal plate hub 206. As described above, this fastening of the seal gland 304 compresses the stationary sleeve 310 between the seal gland 304 and the seal plate hub 206 to prevent rotation of the stationary sleeve 310. During operation, a sealing engagement between rotating sleeve 308 and the stationary sleeve 310 of the mechanical seal 302 prevents process fluid from leaking from the pump housing 106.

Figure 14:
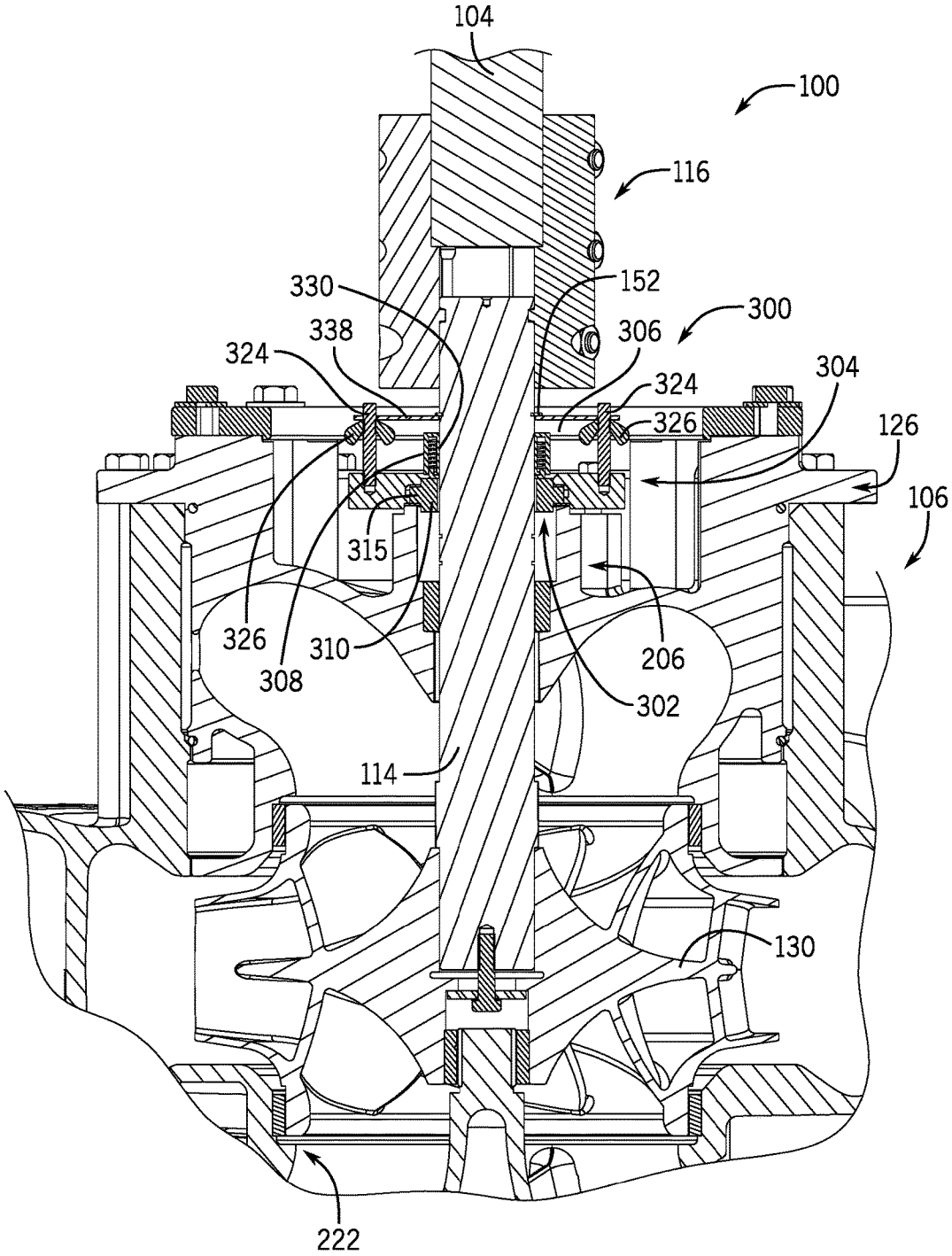
FIG. 14 is a partial cross-sectional view of the pump of FIG. 10 with the seal and jacking assembly of FIG. 10 in a second position according to another embodiment of the invention.

From the arrangement shown in FIG. 13, once the pump 100 is no longer in operation, the jacking elements 326 are threaded along the threaded rods 324 to displace, or jack, the jacking plate 306 towards the second position whereat the pump shaft recess 330 of the jacking plate 306 engages the retaining ring 152, as shown in FIG. 14. With the jacking plate 306 in the second position, the seal gland 304 supports the weight of the pump shaft 114 and the impeller 130. This allows the pump shaft 114 and the motor shaft 104 to be decoupled by removing the fastening elements 161 from the coupling assembly 116 and then removing the coupling assembly 116.

Figure 15:
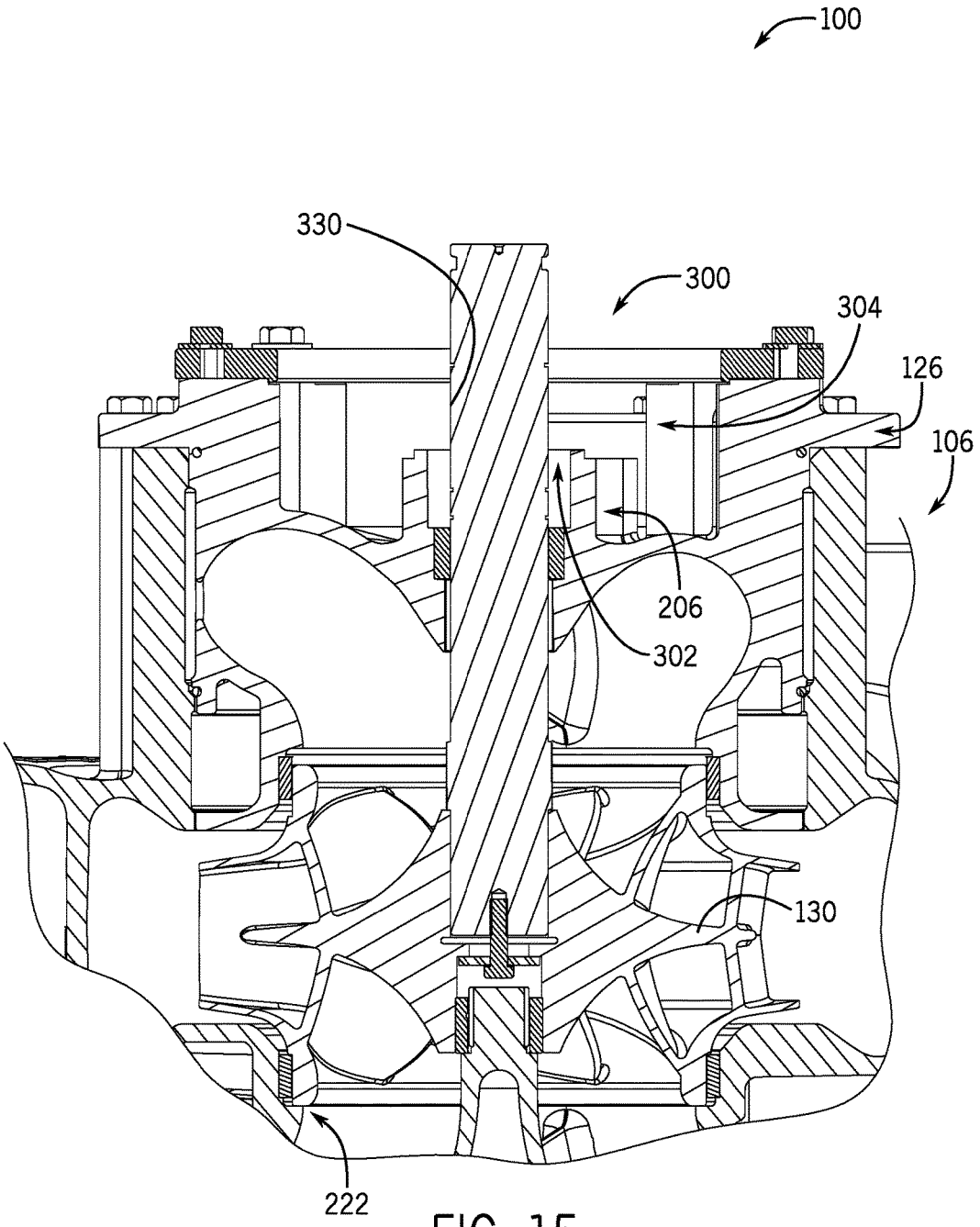
FIG. 15 is a partial cross-sectional view of the pump of FIG. 10 with the coupling assembly, the seal gland, the jacking plate, and the mechanical seal of FIG. 10 removed according to another embodiment of the invention.

Once the coupling assembly 116 is removed and the pump shaft 114 and the motor shaft 104 are decoupled, the jacking elements 326 can be threaded along the threaded rods 324 to move the jacking plate 306 back towards the first position (i.e., towards the mechanical seal 302). Since the pump shaft 114 and the motor shaft 104 are now decoupled, the lowering (i.e., moving from the second position towards the first position) of the jacking plate 306 simultaneously lowers the pump shaft 114 and the impeller 130. The pump shaft 114 and impeller 130 are continued to be lowered via the jacking plate 306 until the impeller 130 contacts the shoulder 222 within the pump housing 106, as shown in FIG. 15. With the weight of the impeller 130 supported by the shoulder 222 of the pump housing 106, the retaining ring 152 can be removed from the pump shaft 114 to permit the seal gland 304 to be removed. Removing the seal gland 304 provides access to the mechanical seal 302. At this point, the mechanical seal 302 can be removed, service, and/or replaced. The pump 100 is then reassembled, for instance with a new mechanical seal 302, by repeating the above-described steps in reverse order.

In some methods, the threaded rods 324 can be installed at the time of jacking. That is, the threaded rods 324 and the jacking elements 326 can be removed during operation of the pump 100 and be installed as part of the removal, service, and replacement of the mechanical seal 302. Once the maintenance is completed, the threaded rods 324 and the jacking elements 326 can be removed for reuse during subsequent maintenance procedures or discarded.

Figure 16:
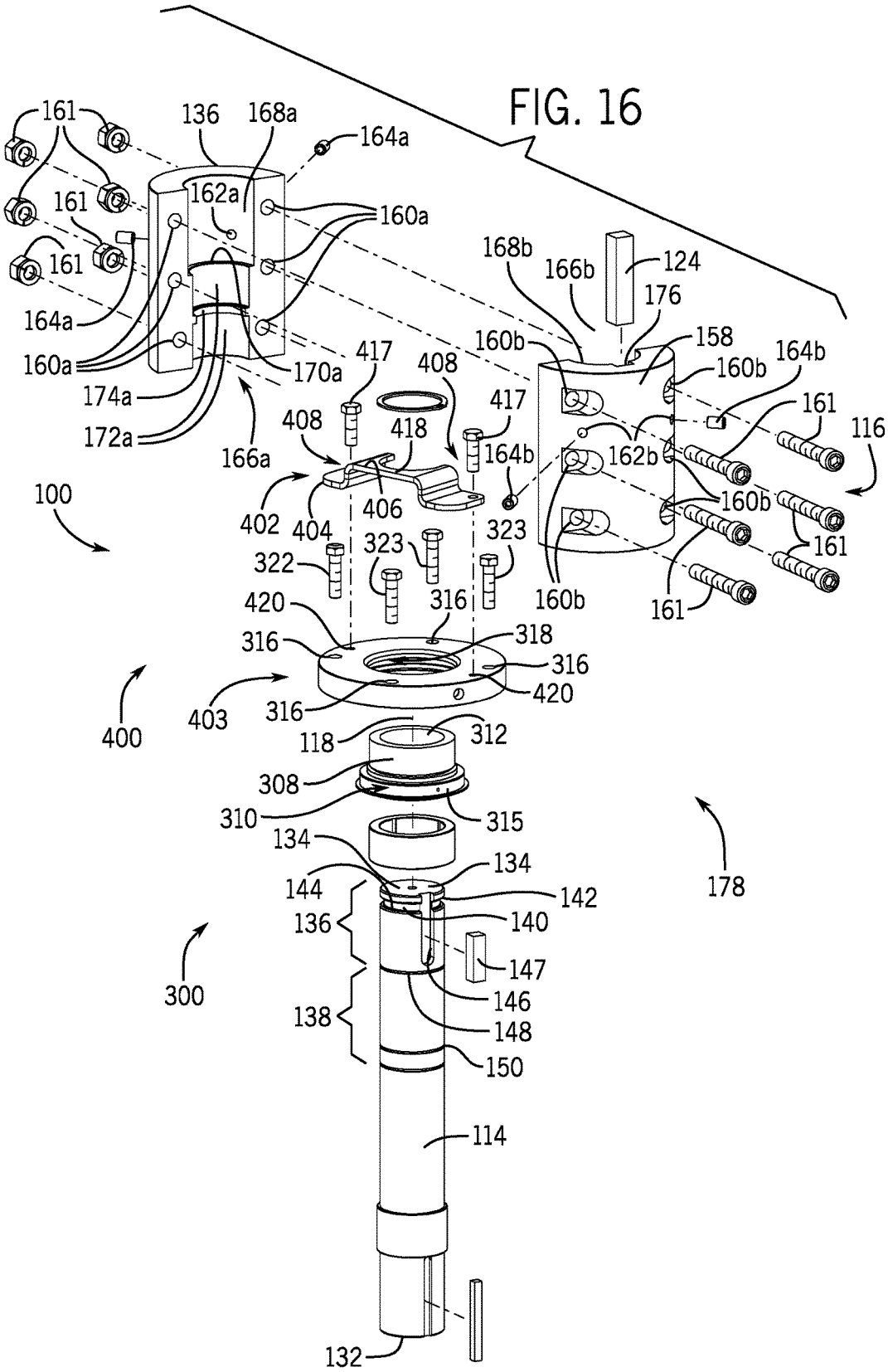
FIG. 16 is an exploded view of a seal and jacking assembly of the pump of FIG. 1 according to a further embodiment of the invention.

FIG. 16 shows a seal and jacking assembly 400 according to another embodiment of the present invention. Similar to the seal and jacking assembly 300, described above, the seal and jacking assembly 400 can be utilized when the pump 100 is constructed with an external mechanical seal (e.g., John Crane Type 8B2). As shown in FIG. 16, the seal and jacking assembly 400 includes similar features as the seal and jacking assembly 300, with similar components identified using like reference numerals. The differences between the seal and jacking assembly 400 and the seal and jacking assembly 300 are described below, or are otherwise apparent from FIGS. 16-18.

Figure 17:
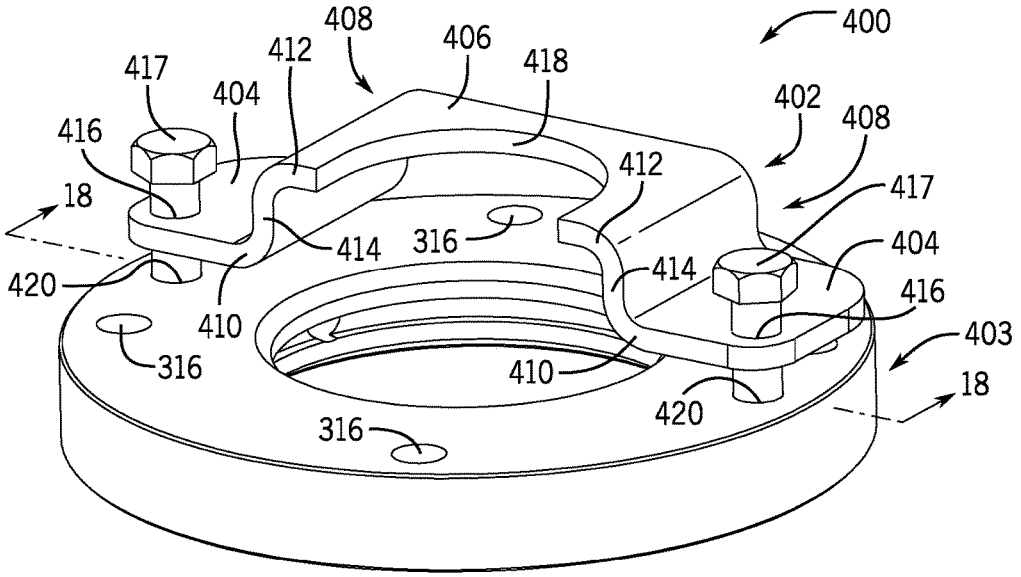
FIG. 17 is an isometric view of a seal gland and a jacking plate of FIG. 16.
Figure 18:
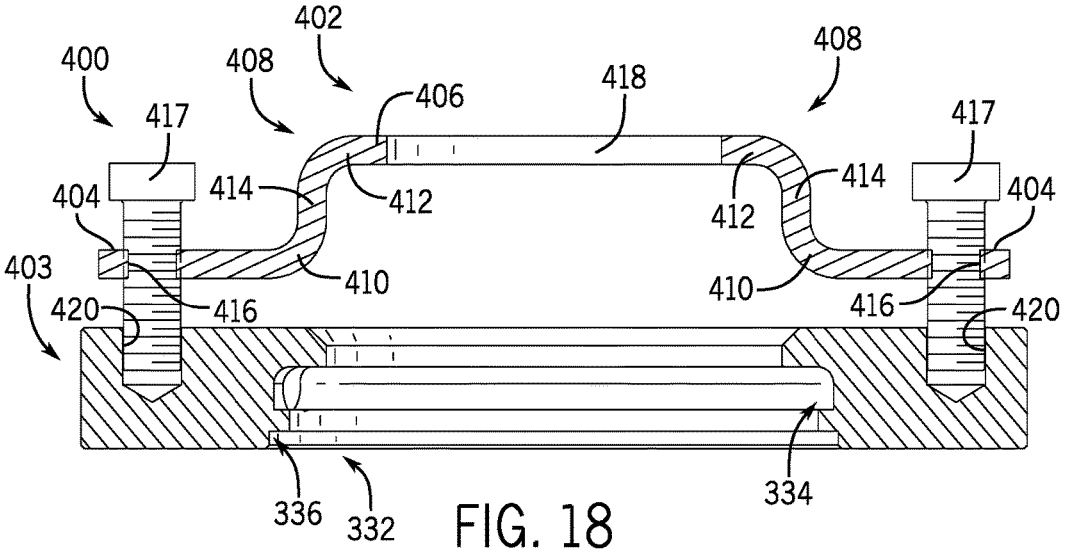
FIG. 18 is a cross-sectional view of the seal gland and the jacking plate of FIG. 17 taken along line 18-18.

As shown in FIG. 16, the seal and jacking assembly 400 includes a jacking plate 402 and a seal gland 403. The jacking plate 402 includes a pair of opposing flanges 404 arranged at the ends of the jacking plate 402, and a centrally raised portion 406 arranged between the pair of flanges 404. The pair of flanges 404 and the centrally raised portion 406 are connected by a pair of vertically extending wall sections 408. As shown in FIGS. 17 and 18, each of the vertically extending wall sections 408 include a first curved wall 410, a second curved wall 412, and a vertical wall 414 arranged between the first curved wall 410 and the second curved wall 412. When assembled, the first curved walls 410 arc upwards towards the motor 102 and the second curved walls 412 arc towards the pump shaft 114. The vertical walls 414 are arranged substantially parallel to the pump axis 114. The pair of flanges 404 each include a threaded jacking aperture 416 extending through the respective flange 404. The threaded jacking apertures 416 are each configured to receive a corresponding jacking element 417. The illustrated jacking elements 417 are in the form of a threaded bolt. The centrally raised portion 406 includes a pump shaft recess 418. The pump shaft recess 418 defines a generally semi-circular shape that includes a radius that is greater than a radius defined by the pump shaft 114, but less than the radius defined by the retaining ring 152. In this way, the jacking plate 402 is configured to slidably displace along the pump shaft 114 until the jacking plate 402 is stopped by the pump shaft recess 418 engaging the retaining ring 152.

The jacking plate 403 is similar to the jacking plate 304 except that the jacking plate 403 includes a pair of clearance apertures 420 which are not threaded. The clearance apertures 420 are each configured to receive and support a corresponding jacking element 417 such that the jacking elements 417 are free to rotate within the clearance apertures 420 during displacement of the jacking plate 402.

The operation of the seal and jacking assembly 400 when performing maintenance on the pump 100 to service the mechanical seal 302 is similar to the operation of the seal and jacking assembly 300, described above with reference to FIGS. 13-15. However, instead of threading the jacking elements 326 along the threaded rods 324 to displace the jacking plate 306 between the first position and the second position, the jacking plate 402 is displaced between the first position and the second position by rotating the jacking elements 417, received within the corresponding threaded jacking aperture 416, in the appropriate direction causing relative axial movement between the jacking plate 402 and the seal gland 304. During displacement of the jacking plate 402, the jacking elements 417 rotate freely within the pair of clearance apertures 420. Thus, the seal and jacking assembly 400 enables efficient removal, service, and replacement of the mechanical seal 302 during maintenance of the pump 100.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A pump comprising:

a motor coupled to a motor shaft;

a pump housing including an inlet and an outlet;

a seal plate coupled to the pump housing and including a seal plate hub protruding from an inner seal plate surface towards the motor, the seal plate hub defining a pump shaft aperture dimensioned to receive a pump shaft and including a plurality of mounting supports each extending radially from a periphery of the seal plate hub;

an impeller arranged within the pump housing and coupled to the pump shaft, the pump shaft defining a pump axis and extending from a first end arranged within the pump housing and coupled to the impeller to a second end protruding from the pump shaft aperture of the seal plate hub;

a coupling assembly removably providing rotational coupling of the motor shaft and the pump shaft;

a seal and jacking assembly including a mechanical seal and a seal gland, the mechanical seal and the seal gland each including a central aperture dimensioned to receive the pump shaft, the seal gland enclosing the pump shaft aperture of the seal plate hub and removably coupled to the plurality of mounting supports of the seal plate hub, the seal gland including a pair of threaded jacking apertures extending axially through the seal gland each configured to receive a jacking element;

wherein when the seal gland is decoupled from the plurality of mounting supports, the seal gland is moveable axially between a first position whereat the seal gland engages the mechanical seal and a second position whereat the seal gland engages a retaining ring coupled to the pump shaft in response to rotation of the jacking elements received within the pair of threaded jacking apertures.

2. The pump of claim 1, wherein the jacking elements are threaded bolts.

3. The pump of claim 1, wherein an opposing pair of the plurality of mounting supports define a thickness that is greater than a thickness defined by another opposing pair of the plurality of mounting supports.

4. The pump of claim 3, wherein the jacking elements engage the opposing pair of the plurality of mounting supports that define a greater thickness to move the seal gland between the first position and the second position.

5. The pump of claim 1, wherein the seal gland includes an annular disk extending away from the pump axis, a central hub extending substantially perpendicularly from the interior of the annular disk, and a seal lip.

6. The pump of claim 5, wherein the pair of opposing threaded jacking apertures extend axially through the annular disk.

7. The pump of claim 5, wherein the central hub of the seal gland extends towards the motor.

8. The pump of claim 5, wherein the annular disk includes a plurality of fastening recesses formed on a periphery of the annular disk and spaced circumferentially around the periphery of the annular disk.

9. The pump of claim 5, wherein seal lip extends towards the pump axis from a distal end of the central hub and defines the central aperture of the seal gland.

10. A pump comprising:

a motor coupled to a motor shaft;

a pump housing including an inlet and an outlet;

a seal plate coupled to the pump housing and including a seal plate hub protruding from an inner seal plate surface towards the motor, the seal plate hub defining a pump shaft aperture dimensioned to receive a pump shaft and including a plurality of mounting supports each extending radially from a periphery of the seal plate hub;

an impeller arranged within the pump housing and coupled to the pump shaft, the pump shaft defining a pump axis and extending from a first end arranged within the pump housing and coupled to the impeller to a second end protruding from the pump shaft aperture of the seal plate hub;

a coupling assembly removably providing rotational coupling of the motor shaft and the pump shaft;

a seal and jacking assembly including a mechanical seal, a seal gland, and a jacking plate, the mechanical seal and the seal gland each including a central aperture dimensioned to receive the pump shaft, the seal gland removably coupled to the plurality of mounting supports of the seal plate hub and including a pair of threaded jacking apertures extending axially partially through the seal gland, each of the pair of threaded jacking apertures configured to receive a threaded rod, the threaded rods each configured to receive a jacking element;

a retaining ring arranged on the pump shaft axially between the jacking plate and the second end of the pump shaft;

wherein the jacking elements are selectively rotatable to axially translate the jacking plate, and wherein the selective rotation of the jacking elements is configured to axially translate the jacking plate along the pump shaft from a first position axially between the mechanical seal and the retaining ring to a second position whereat the jacking plate engages the retaining ring.

11. The pump of claim 10, wherein the jacking elements are wing nuts.

12. The pump of claim 10, wherein the jacking plate defines a substantially flat shape and is arranged substantially perpendicular to the pump axis.

13. The pump of claim 10, wherein the jacking plate includes a pair of jacking recesses arranged at opposing ends of the jacking plate and a pump shaft recess arranged in-between the pair of jacking recesses.

14. The pump of claim 13, wherein the pump shaft recess defines a generally semi-circular shape that includes a radius that is greater than a radius defined by the pump shaft and less than the radius defined by the retaining ring.

15. A pump comprising:

a motor coupled to a motor shaft;

a pump housing including an inlet and an outlet;

a seal plate coupled to the pump housing and including a seal plate hub protruding from an inner seal plate surface towards the motor, the seal plate hub defining a pump shaft aperture dimensioned to receive a pump shaft and including a plurality of mounting supports each extending radially from a periphery of the seal plate hub;

an impeller arranged within the pump housing and coupled to the pump shaft, the pump shaft defining a pump axis and extending from a first end arranged within the pump housing and coupled to the impeller to a second end protruding from the pump shaft aperture of the seal plate hub;

a coupling assembly removably providing rotational coupling of the motor shaft and the pump shaft;

a seal and jacking assembly including a mechanical seal, a seal gland, and a jacking plate, the mechanical seal and the seal gland each including a central aperture dimensioned to receive the pump shaft, the seal gland removably coupled to the plurality of mounting supports of the seal plate hub and including a pair of clearance apertures extending axially partially through the seal gland, each of the pair clearance apertures configured to receive and support a jacking element;

a retaining ring arranged on the pump shaft axially between the jacking plate and the second end of the pump shaft;

wherein the jacking elements are selectively rotatable to axially translate the jacking plate, and wherein the selective rotation of the jacking elements is configured to axially translate the jacking plate along the pump shaft from a first position axially between the mechanical seal and the retaining ring to a second position whereat the jacking plate engages the retaining ring.

16. The pump of claim 15, wherein the jacking plate includes a pair of flanges arranged at opposing ends of the jacking plate and a centrally raised portion arranged between the pair of flanges.

17. The pump of claim 16, wherein the pair of flanges of the jacking plate each include a threaded jacking aperture.

18. The pump of claim 16, wherein the pair of flanges and the centrally raised portion are connected by a pair of vertically extending wall sections.

19. The pump of claim 18, wherein the pair of vertically extending wall sections each including a first curved wall, a second curved wall, and a vertical wall arranged between the first curved wall and the second curved wall.

20. The pump of claim 19, wherein first curved walls arc upwards towards the motor, the second curved walls arc towards the pump shaft, and the vertical walls are arranged substantially parallel to the pump axis.

* * * * *